US009689134B1

(12) United States Patent
Li

(10) Patent No.: US 9,689,134 B1
(45) Date of Patent: Jun. 27, 2017

(54) HELICAL PILE COUPLER, ASSEMBLY, AND METHOD

(71) Applicant: 351471 Alberta Ltd., Edmonton (CA)

(72) Inventor: Baocheng Li, Edmonton (CA)

(73) Assignee: 351471 Alberta Ltd., Edmonton (CA)

( * ) Notice: Subject to any disclaimer, the term of this patent is extended or adjusted under 35 U.S.C. 154(b) by 0 days.

(21) Appl. No.: 14/966,448

(22) Filed: Dec. 11, 2015

(30) Foreign Application Priority Data

Dec. 8, 2015 (CA) ..... 2914598

(51) Int. Cl.

| | |
|---|---|
| ***E02D 5/52*** | (2006.01) |
| ***E02D 7/22*** | (2006.01) |
| ***E02D 5/24*** | (2006.01) |
| ***E02D 5/56*** | (2006.01) |
| ***E02D 5/28*** | (2006.01) |
| ***E02D 27/12*** | (2006.01) |

(52) U.S. Cl.
CPC ..... *E02D 5/526* (2013.01); *E02D 5/24* (2013.01); *E02D 5/28* (2013.01); *E02D 5/56* (2013.01); *E02D 7/22* (2013.01); *E02D 27/12* (2013.01)

(58) Field of Classification Search
USPC ..... 405/232, 251, 25.1; 403/75
See application file for complete search history.

(56) References Cited

U.S. PATENT DOCUMENTS

| | | | | |
|---|---|---|---|---|
| 4,907,911 | A * | 3/1990 | Rodriguez | F16L 55/179 138/97 |
| 2004/0028481 | A1* | 2/2004 | Pinkleton | E02D 5/801 405/259.1 |
| 2010/0143048 | A1* | 6/2010 | Lin | E02D 5/523 405/244 |

* cited by examiner

*Primary Examiner* — Kyle Armstrong
(74) *Attorney, Agent, or Firm* — Marsh Fischmann & Breyfogle LLP; Jonathon A. Szumny

(57) ABSTRACT

A helical pile coupler, assembly, and method of assembly. The assembly comprises a first pile segment having first end with a coupler attached thereto. The coupler has two or more coupler aperture pairs and the alignment of at least one of the coupler aperture pairs is radially offset from the alignment of at least one other coupler aperture pair. A second pile segment is receivable in the coupler and the second pile segment has two or more pile aperture pairs that can be aligned with at least two of the two or more coupler aperture pairs, including the at least one radially offset coupler aperture pair. Fasteners are extended through the aligned aperture pairs to secure the second pile segment to the coupler. The fasteners are configured to protrude minimally from the outer surface of the coupler.

19 Claims, 2 Drawing Sheets

HELICAL PILE COUPLER, ASSEMBLY, AND METHOD

TECHNICAL FIELD

A coupler and a method for connecting pile segments in helical piles are provided.

BACKGROUND

Anchoring systems forming the foundations of buildings or other large structures are commonly used where adequate bearing capacity cannot be found to support the structural loads. Helical piles, which have a hollow pipe shaft with one or more spiral helical plates affixed thereto, can be rotated into the ground to support structures, providing a versatile and efficient alternative to conventional piling foundation systems.

Helical piles are typically rotationally driven into the ground by a hydraulic torque motor mounted at the top of a pile. Pile segments, with or without spiral helical plates affixed thereto, may be joined end to end to form a helical pile which is installed to desired soil depths to achieve the desired load-bearing capacity. Pile segments are typically joined by complicated, costly fabricated transition couplings or by welding at the job site when the helical pile is installed, which can be time-consuming and expensive.

SUMMARY

According to a broad aspect of the present invention, there is provided a method for connecting a first pile segment to a second pile segment of a helical pile system, the method comprising: inserting a first end of the second pile segment into a coupler provided on a first end of the first pile segment, the second pile segment having a pile sidewall and two or more pile aperture pairs formed in the pile sidewall, each of which having an alignment, and the alignment of at least one of the two or more pile aperture pairs is radially offset from the alignment of at least one other pile aperture pair; and the coupler having a coupler sidewall and two or more coupler aperture pairs formed in the coupler sidewall, each of which having an alignment, and the alignment of at least one of the two or more coupler aperture pairs is radially offset from the alignment of at least one other coupler aperture pair; aligning at least two of the two or more pile aperture pairs, including the at least one pile aperture pair having the radially offset alignment, with at least two of the two or more coupler aperture pairs, including the at least one coupler aperture pair having the radially offset alignment; inserting a fastener through each of the at least two aligned pile and coupler aperture pairs such that each end of the fastener extends through and engages both the pile sidewall and the coupler sidewall; and securing the fastener to prevent the fastener from being slidingly removable from the at least two aligned pile and coupler aperture pairs.

According to another broad aspect of the present invention, there is provided a coupler for connecting a first pile segment and a second pile segment in helical pile system, the first pile segment having a first end and the second pile segment having a sidewall, a first end, and two or more pile aperture pairs formed in the sidewall near the first end, the coupler comprising: a sidewall; a first end for connection to the first end of the first pile segment; a second end for receiving the first end of the second pile segment, the second end having two or more coupler aperture pairs formed in the sidewall, each of which having an alignment, and the alignment of at least one of the two or more coupler aperture pairs is radially offset from the alignment of at least one other coupler aperture pair, the two or more coupler aperture pairs for alignment with the two or more pile aperture pairs and each for receiving a fastener therethrough.

According to yet another broad aspect of the present invention, there is provided a helical pile assembly comprising: a first pile segment having a sidewall and a first end; a coupler having a sidewall, a first end connected to the first pile segment, a second end, two or more coupler aperture pairs formed in the sidewall near the second end, each of the coupler aperture pairs having an alignment and the alignment of at least one of the coupler aperture pairs being radially offset from the alignment of at least one other coupler aperture pair; a second pile segment having a sidewall, a first end received in the coupler at the second end of the coupler, and two or more pile aperture pairs formed in the sidewall near the first end and aligned with at least two of the two or more coupler aperture pairs, including the at least one coupler aperture pair having the radially offset alignment; and a fastener received in each pair of the aligned pile and coupler aperture pairs to secure the second pile segment to the coupler.

DESCRIPTION OF THE DRAWINGS

Referring to the figures wherein like reference numerals indicate similar parts throughout the several views, several aspects of the present invention are illustrated by way of example, and not by way of limitation, in detail in the figures, wherein.

DESCRIPTION OF EMBODIMENTS

Figure 1A:
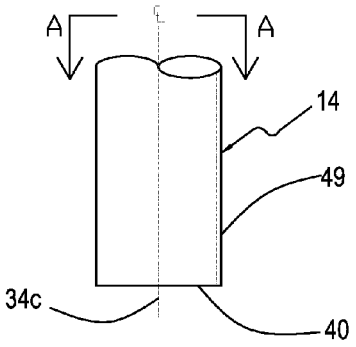
FIG. 1A is an elevation view of a first end of a first pile segment usable with the present invention.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

According to embodiments herein, a coupler and a method for connecting pile segments in helical piles are provided. The coupler and method described herein aim to provide an alternative way to connect pile segments in helical piles. The present invention will now be described having regard to the enclosed figures.

By way of background, helical piles, also known as screw piles or screw anchors, are deep foundation elements that have circular steel plates pressed into a spiral shape with a uniform pitch around the pile shaft. Helical piles are well known and commonly used to transfer the load from the shaft into the surrounding soil. Helical piles are rotated or screwed into the soil at their "lead" or "toe" ends by the application of rotational forces, or torque, and/or axial downward forces.

It is known that the installation of helical piles can be assisted by the addition of one or more helices to each pile. As such, piles with multiple helices must be manufactured to withstand the torque, friction, and/or axial forces required to rotate the shaft into the ground. The configuration of helical piles is generally dictated by many factors including the required length of the pile shaft, the geographic location of the structure being built, the surrounding soil characteristics, the size and number of helical plates, and the anticipated load. Helixes are commonly attached to the pile shaft in such a manner as to allow the plates to displace the soil, rather than to excavate the soil. The helix serves as screw threads to force penetration into the ground when the pile is rotated. Helixes are commonly positioned along the pile shaft near the lead end being positioned in the ground.

It may be difficult to accurately predict the length of the piles that will be required for a specific job due to the uncertainty of ground conditions. Helical piles are typically screwed into the ground to a point at which a predetermined torque limit is reached. It is difficult to predict what the depth of insertion will be when this torque limit is reached, due primarily to the unpredictable nature of local soil conditions. Therefore, it is often necessary to add one or more pile segments to extend the shaft of the helical piles. Each pile segment may have one or more spiral helical plates affixed thereto or may be devoid of helical plates.

In accordance with the principles of the present invention, a coupler is provided for fitting over a first end of a first pile segment to enhance the thickness of the cylindrical wall at the first end of the first pile segment. The coupler is provided with two or more aperture pairs, each pair extending substantially transverse to the longitudinal axis of the coupler. In one embodiment, at least one of the two or more aperture pairs extends at an angle offset from that of another aperture pair. The first end of the pile segment may be the lower end of an extension pile segment, adapted to connect with the upper end of another pile segment (which may be the lead pile), or may be the upper end of a pile segment (which may be the lead pile), adapted to connect with the lower end of another pile segment. In either case, the combination of the pile segment and the coupler presents a coaxial pair of tubular sections that have a collective wall thickness greater than the wall thickness of just the pile segment.

Figure 6B:
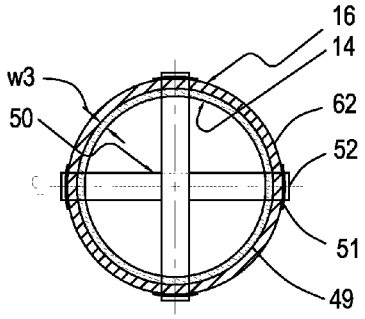
FIG. 6B is a cross-sectional view of the helical pile assembly in FIG. 6A, along line D-D.
Figure 6A:
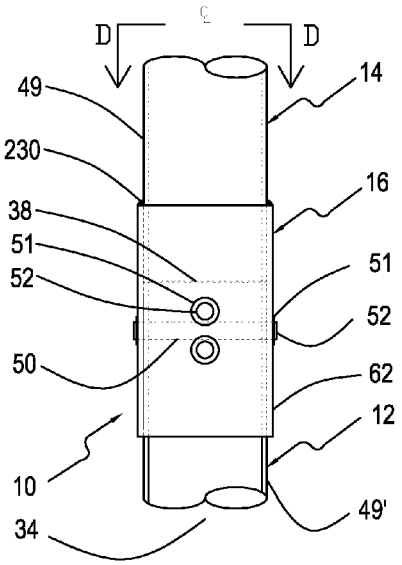
FIG. 6A is an elevation view of a helical pile assembly wherein the second pile segment in FIG. 3 is connected to the pile segment and coupler in FIG. 4A, according to one embodiment of the present invention.
Figure 6C:
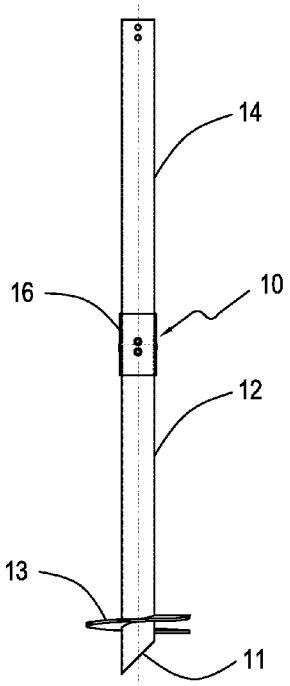
FIG. 6C is another elevation view of the helical pile assembly of FIG. 6A, showing the full length of the first and second pile segments.

With reference to FIGS. 6A to 6C, there is shown a helical pile assembly 10 comprised of a second pile segment 12 and a first pile segment 14 joined together by a coupler 16 as will be described hereinafter. Pile segments 12 and 14 are tubular members, which may be in the form of a substantially cylindrical metal pipe with or without helical plate(s) mounted thereto. Of course, pile segments 12 and 14 may be tubular members of other shapes or cross-sections, including for example square, hexagonal, etc.

Pile segment 12 may be the leading pile, the lower (or "leading") end of which (not shown) may be formed to enhance cutting into the ground. For example, a beveled edge 11 may be formed at the leading end of the leading pile. The leading pile may also have one or more helixes 13. Other configurations for the leading end of the leading pile are possible. The upper (or "trailing") end 36 of pile segment 12 (shown in FIG. 3) is preferably substantially perpendicular to longitudinal axis 34*a* of pipe 12, and end 36 is to be coupled to pile segment 14 by coupler 16 as will be hereinafter described.

Figure 1B:
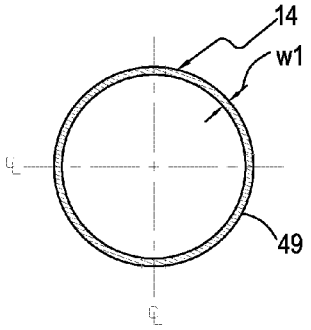
FIG. 1B is a cross-sectional view of the pile segment in FIG. 1A, along line A-A.

Pile segment 14 may be an extension pile shaft or the shaft of a torque motor driver. With reference to FIG. 1A and FIG. 1B, pile segment 14 has a lower (or "leading") end 40 for connection to pile segment 12. Leading end 40 is preferably substantially perpendicular to longitudinal axis 34*c* of pile segment 14. In the illustrated embodiment, pile segment 14 has a substantially cylindrical sidewall 49 (shown in FIG. 1B) defining a wall thickness W1 between the inner radius and outer radius thereof. Pile segment 12 preferably has the same or a similar cross-section as pile segment 14 (as shown in FIG. 1B), and may have the same or a similar wall thickness and outer diameter as pile segment 14. Although the dimensions need not be the same, for purposes of describing the invention, pile segments 12 and 14 have substantially the same diameters.

In one embodiment, end 36 of pile segment 12 and the end 40 of pile segment 14 are connected by coupler 16 using two or more fasteners 50, which will be described in more detail hereinafter. The connection can be accomplished at ends 36 and 40 of pile segments 12 and 14, respectively, by providing one of ends 36 or 40 with coupler 16.

Figure 2:
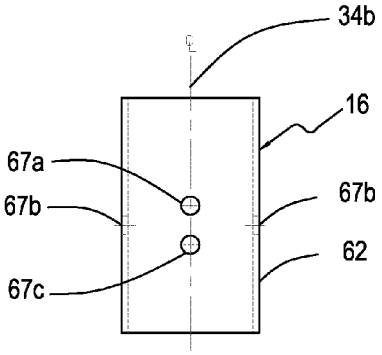
FIG. 2 is an elevation view of a coupler according to one embodiment of the present invention.
Figure 4A:
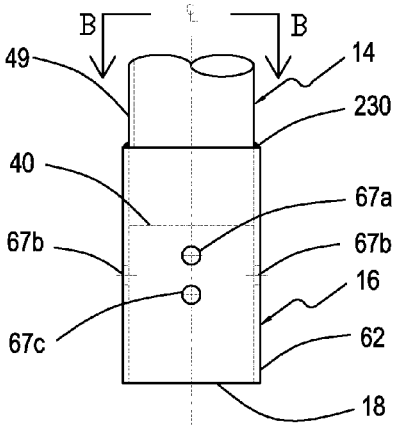
FIG. 4A is an elevation view of the pile segment in FIG. 1A connected to the coupler in FIG. 2, according to one embodiment of the present invention.
Figure 4B:
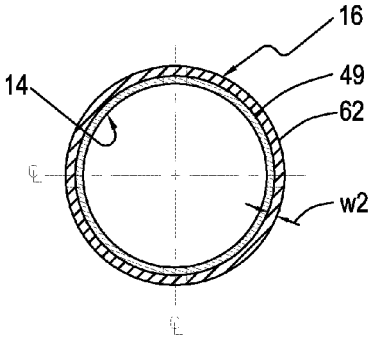
FIG. 4B is a cross-sectional view of the pile segment and coupler in FIG. 4A, along line B-B.

With reference to FIG. 2 and FIG. 4B, coupler 16 is a tubular member, which may be for example a substantially cylindrical sleeve. Of course, coupler 16 may be a tubular member of other shapes or cross-sections, including for example square, hexagonal, etc. Coupler 16 has a sidewall 62 having an inner radius and an outer radius, together defining a wall thickness W2. In a preferred embodiment, coupler 16 has two or more aperture pairs 67*a*, 67*b*, 67*c* formed in sidewall 62, with the alignment of each pair extending substantially transverse to longitudinal axis 34*h* of the coupler. An "aperture pair" comprises two apertures at substantially the same axial location of sidewall 62 but separated radially on the sidewall thereby defining an angle therebetween relative to axis 34*b*. For example, in the illustrated embodiment, aperture pair 67*b* has two apertures at substantially the same axial location of sidewall 62 and separated radially by approximately 180°. Of course, in other embodiments, the apertures in an aperture pair may be radially separated by other angles.

The word "alignment" herein refers to an imaginary line extending between the center points of the apertures in an aperture pair. In the illustrated embodiment, the alignment of each aperture pair 67*a*, 67*b*, 67*c* is shown to pass through the central longitudinal axis 34*b* of coupler 16 but the alignment of each aperture pair need not extend through axis 34*b*. In other words, the alignment of one or more of the aperture pairs may be offset from axis 34*b*.

Preferably, the alignment of at least one of the two or more aperture pairs in coupler 16 is radially offset from that of another aperture pair, thereby defining an angle therebetween. For example, in the illustrated embodiment, the alignment of aperture pair 67*a* is offset from the alignment of aperture pair 67*b* by about 90°. Of course, in other embodiments, other offset angles are possible. Although not necessary, consecutive aperture pairs may have a different radial alignment from one another. Further, two aperture pairs having substantially the same radial alignment may be separated by an aperture pair having an alignment that is radially offset from the alignment of the two aperture pairs. For example, in the illustrated embodiment, aperture pair with the radially offset alignment 67*b* is positioned between two aperture pairs 67*a*, 67*c* having a substantially parallel radial alignment.

Aperture pairs may be positioned closely, one after another, axially on sidewall 62. For example, in the illustrated embodiment, aperture pair 67*a* is at a first axial location in sidewall 62, and aperture pair 67*b* is at a second axial location in sidewall 62 immediately adjacent to the edge of aperture pair 67*a*. Similarly, aperture pair 67*c* is at third axial location in sidewall 62 immediately adjacent to the edge of aperture pair 67*b*. Of course, in other embodiments, there may be some axial distance between adjacent aperture pairs.

For the sake of simplicity, coupler 16 will be described for attachment to end 40 of pile segment 14, although it will be appreciated that coupler 16 could be for attachment to end 36 of pile segment 12. With reference to FIG. 4A and FIG. 4*b*, the inner diameter of coupler 16 is preferably approximately equal to or slightly larger than the outer diameter of pipe 14 so as to fit external of pipe 14 at end 40, preferably snugly thereon. Coupler 16 is affixed to pipe 14 so as to extend along end 40 thereof in an overlapping and/or substantially coaxial manner, and to extend outwardly therefrom to maintain open access to the two or more aperture pairs 67*a*, 67*b*, 67*c*. In one embodiment, coupler 16 is slid over end 40 to overlap with same from the end and coupler 16 is attached to end 40 by a substantially circumferential weld 230 on the outer surface of sidewall 49. The length of the overlap between coupler 16 and end 40 may vary depending on one or more of: the diameter and length of pile segment 14; the diameter and length of coupler 16; and the axial location of the two or more aperture pairs 67*a*, 67*b*, 67*c*. Once attached to pile segment 14, coupler 16 has a free open end 18, opposite its end that is welded to pile segment 14.

In an alternative embodiment, pile segment 14 and coupler 16 are formed from a unitary piece of material such that coupler 16 is part of pile segment 14 and no connection step is required. For example, leading end 40 of pile segment 14 may be formed as a bell end having a larger inner diameter than the remaining length of the pile segment. Aperture pairs are then formed in the sidewall of the bell end. The bell end then functions as coupler 16 for receiving trailing end 36 of pile segment 12.

Figure 3:
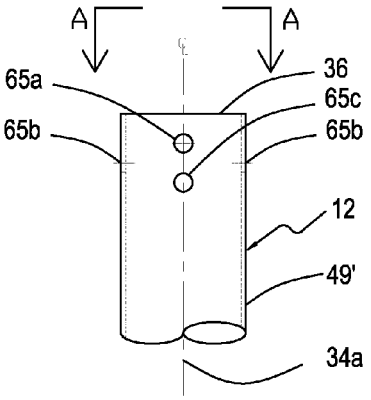
FIG. 3 is an elevation view of a second end of a second pile segment usable with the present invention.

With reference to FIG. 3 and FIG. 6B, pile segment 12 has a sidewall 49' having an inner radius and an outer radius, together defining a wall thickness W3. In a preferred embodiment, pile segment 12 has two or more aperture pairs 65*a*, 65*b*, 65*c* formed in sidewall 49', with the alignment of each pair extending substantially transverse to longitudinal axis 34*a* of the pile segment. An "aperture pair" comprises two apertures at substantially the same axial location of sidewall 49' but separated radially on the sidewall thereby defining an angle therebetween relative to axis 34*a*. For example, in the illustrated embodiment, aperture pair 65*b* has two apertures at substantially the same axial location of sidewall 49' and separated radially by approximately 180°. Of course, in other embodiments, the apertures in an aperture pair may be radially separated by other angles.

In the illustrated embodiment, the alignment of each aperture pair 65*a*, 65*b*, 65*c* is shown to pass through the central longitudinal axis 34*a* of pile segment 12 but the alignment of each aperture pair need not extend through axis 34*a*. In other words, the alignment of one or more of the aperture pairs may be offset from axis 34*a*.

Preferably, the alignment of at least one of the two or more aperture pairs in pile segment 12 is radially offset from that of another aperture pair, thereby defining an angle therebetween. For example, in the illustrated embodiment, the alignment of aperture pair 65*a* is offset from the alignment of aperture pair 65*b* by about 90°. Of course, in other embodiments, other offset angles are possible.

Aperture pairs may be positioned closely, one after another, axially on sidewall 49'. For example, in the illustrated embodiment, aperture pair 65*a* is at a first axial location in sidewall 49', and aperture pair 65*b* is at a second axial location in sidewall 49' immediately adjacent to the edge of aperture pair 65*a*. Similarly, aperture pair 65*c* is at third axial location in sidewall 49' immediately adjacent to the edge of aperture pair 65*b*. Of course, in other embodiments, there may be some axial distance between adjacent aperture pairs.

With reference to FIGS. 6A and 6B, the inner diameter of free end 18 and at least the axial portion of coupler 16 where the two or more aperture pairs 67*a*, 67*b*, 67*c* are located is approximately equal to or slightly larger than the outer diameter of pile segment 12 at and near end 36, so as to removably receive therein end 36 of pile segment 12.

The inner diameter of coupler 16 need not be consistent throughout the length of the coupler. For example, coupler 16 may have an attachment end for connection to pile segment 14, as described above, and a bell end with a larger inner diameter than the attachment end. The bell end is for receiving end 36 of pile segment 12, which may have a larger outer diameter than pile segment 14. The reverse, wherein the inner diameter of the attachment end of coupler 16 is larger than that of free end 18, is also possible, depending on the dimensions of pile segment 14 and pile segment 12 relative to one another.

Coupler 16 and pile segment 12 are configured such that when end 36 is received in coupler 16, at least two of the two or more aperture pairs in coupler 16 and pile segment 12 can be aligned with one another to allow the passage of a fastener 50 there through, thereby allowing fastener 50 to extend into and through sidewalls 62 and 49' at the aperture locations of each aperture pair. Preferably, the alignment of at least one of the at least two aligned aperture pairs is radially offset from the alignment of another aligned aperture pair. For example, in the illustrated embodiment as shown in FIG. 6A and FIG. 6B, when pile segment 12 is received in coupler 16, the two parts can be radially positioned relative to one another to align aperture pairs 65*a*, 65*b*, and 65*c* with aperture pairs 67*a*, 67*b*, and 67*c*, respectively. The alignment of aperture pairs 65*b*, 67*b* is radially offset from the alignment of aperture pairs 65*a*, 67*a* by about 90°. The aligned aperture pairs are for receiving fastener 50 to secure end 36 of pile segment 12 to coupler 16.

In a preferred embodiment, coupler 16 and pile segment 12 have the same number of aperture pairs and that all the aperture pairs can be aligned simultaneously to form aligned aperture pairs to each receive a fastener 50 therethrough. For example, as shown in the illustrated embodiment, coupler 16 and pile segment 12 each have three aperture pairs and all three pairs can be aligned simultaneously with the corresponding pairs to form three aligned aperture pairs. In another embodiment, coupler 16 and pile segment 12 have a different number of aperture pairs and all of the aperture pairs in coupler 16 (or pile segment 12) can be aligned simultaneously with the corresponding pairs in pile segment 12 (or coupler 16) to form aligned aperture pairs.

While the term "sleeve" is used, it will be appreciated that the term is meant to include receiver, socket or other such structure intended to receive therein the substantially coaxial pair of leading end and trailing end.

Figure 5A:
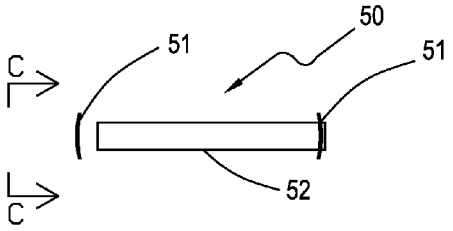
FIG. 5A is an elevation view of a fastener for use with the coupler, according to one embodiment of the present invention.
Figure 5B:
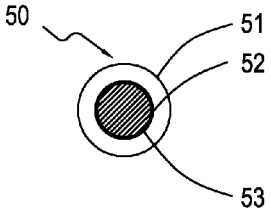
FIG. 5B is a cross-sectional view of the fastener in FIG. 5A, along line C-C.

With reference to FIG. 5A and FIG. 5B, fastener 50 comprises an elongated member 52 which may be, for example, a metal pin. The outer diameter of member 52 is preferably approximately equal to or slightly smaller than the inner diameter of the apertures in aperture pairs 65*a*, 65*b*, 65*c*, 67*a*, 67*b*, 67*c* so as to fit inside the apertures, preferably snugly therein. In one embodiment, fastener 50 further comprises two washers 51, each for receiving an end of member 52. Once an end of member 52 is received therein, washer 51 may be attached to member 52 in various ways, including welding, tack welding 53, friction fitting, etc. In another embodiment, member 52 and one of the washers are formed together from a unitary piece of material. Washers 51 help secure fastener 50 to pile segment 12 and coupler 16 and act as a stopper to prevent member 52 from passing through the aligned aperture pairs entirely. Preferably, member 52 is provided with one of the two washers 51 at a first end thereof prior to placement through the aligned aperture pairs, and the remaining washer is attached to a second end of member 52 after the member is inserted at the second end through the aligned aperture pairs.

In an alternative embodiment, member 52 is an externally threaded elongated member and washers 51 are internally threaded for attachment to the ends of member 52 by threaded connection. Of course, other configurations of member 52 and washers 51 and connection methods thereof are possible.

Once fully inserted through coupler 16 and pile segment 12, fastener 50 engages all four apertures in the pair of aligned apertures, thereby simultaneously engaging sidewalls 62 and 49'. The length of member 52 is slightly greater than the distance at the outer surface of sidewall 62 between the opposing apertures in the aligned aperture pairs (hereinafter the "span" of the aligned aperture pairs). Where the alignment of the aligned aperture pairs passes through axis 34, the span of the aligned aperture pairs is equal to the outer diameter of coupler 16 at the axial location of the opposing apertures. The ends of member 52 protrude slightly from the outer surface of sidewall 62 when it is received in the aligned aperture pairs. The length of member 52, therefore, depends on the span of the aligned aperture pairs through which the member is to be received. The span of one pair of aligned apertures may be different from that of another pair in assembly 10 and consequently members 52 of different lengths may be used to secure pile segment 12 to coupler 16.

In one embodiment, with reference to FIG. 5A and FIG. 6B, washers 51 are contoured such that when fastener 50 is secured to pile segment 12 and coupler 16, the inner and outer faces of washer 51 substantially follow the curvature of the outer surface of sidewall 62, to help minimize the protrusion of washers 51 from sidewall 62 and any gaps between the inner face of washer 51 and the outer surface of sidewall 62. As assembly 10 is placed into the ground as part of a helical pile, soil, debris, etc. may enter any gaps between the inner face of washer 51 and the outer surface of sidewall 62, which may interfere with the structural integrity of the helical pile and/or loosen or undo fastener 50. Further, the protrusion of member 52 and washers 51 from sidewall 62 is preferably kept to a minimum to help minimize soil disturbance as the helical pile is being driven into the ground.

The position of aperture pairs 65*a*, 65*b*, 65*c* and/or aperture pairs 67*a*, 67*b*, 67*c* are selected to allow end 36 of pile segment 12 to be connected to coupler 16 in an overlapping and/or substantially coaxial manner. The length of the overlap between coupler 16 and end 36 may vary depending on one or more of: the diameter and length of pile segment 12; the diameter and length of coupler 16; and the axial location of the two or more aperture pairs 67*a*, 67*b*, 67*c*. In a further embodiment, the position of aperture pairs 65*a*, 65*b*, 65*c* and/or aperture pairs 67*a*, 67*b*, 67*c* are selected to define a gap 38 between ends 36 and 40 in assembly 10 when pile segment 12 is connected to coupler 16. The gap allows for thermal expansion and/or contraction of the parts in assembly 10, which helps prevent structural damages to assembly 10 due to temperature variance. The gap also allows for manufacturing and installation tolerance in the coupler alignment.

Pile segments 12, 14 and coupler 16 may be made of any material that is suitable for helical piles, including for example ASTM A252 Grade 2 or 3 steel pipe, yield strength of 250 MPa or 310 MPa. In some embodiments, the interior of the pipe may be filled with material such as grout or concrete, as will be readily appreciated by those skilled in the art.

To assemble assembly 10, leading end 40 of pile segment 14 is inserted into a first end of coupler 16, in a substantially coaxial manner to overlap with a length of coupler 16 without interfering with open access to the at least two aperture pairs 67*a*, 67*b*, 67*c*. Pile segment 14 is attached to coupler 16 by, for example, welding. Alternatively, pile segment 14 and coupler 16 are manufactured from a unitary piece of material. For example, leading end 40 may be formed to function as coupler 16, as described above. Trailing end 36 of pile segment 12 is inserted into free end 18 of coupler 16 in an overlapping and/or substantially coaxial manner. The axial and radial positions of pile segment 12 and coupler 16 are adjusted relative to one another to align aperture pairs 65*a*, 65*b*, 65*c* with aperture pairs 67*a*, 67*b*, 67*c*.

A fastener 50 is applied to each of the aligned aperture pairs to secure pile segment 12 to coupler 16. In the embodiment shown in FIG. 6A and FIG. 6B, member 52 is inserted into one of aligned aperture pairs to extend through all four apertures in the aligned aperture pairs. Member 52 preferably has one washer 51 attached to a first end thereof prior to insertion, as to prevent member 52 from sliding past the sidewalls 62, 49' and falling into the inner bore of pile segment 12. Once member 52 is inserted to extend through and engage all four apertures in the aligned aperture pairs, a second washer 51 is attached to a second end thereof to prevent member 52 from sliding out of the apertures. Additional members 52 are secured to the remaining aligned aperture pairs in the above described manner.

In embodiments where washers 51 are contoured, the washers and/or member 52 are rotated to allow the contour of washers 51 to follow the curvature of the outer surface of sidewall 62. For example, a member 52 has a first washer 51 attached to a first end thereof and a second end of member 52 is inserted into a pair of aligned apertures. Member 52 and/or the first washer are rotated until the contour of the first washer substantially matches the curvature of the outer surface of sidewall 62 such that the inner surface of the first washer can matingly abut sidewall 62 with minimal physical separation therebetween. Member 52 extends through all four apertures in the aligned aperture pairs, with the second end of member 52 protruding slightly outwardly from the outer surface of sidewall 62. A second washer is placed on the second end of member 52 and the second washer is rotated and positioned until its contour substantially matches the curvature of sidewall 62 and its inner surface matingly abuts sidewall 62 with minimal physical separation therebetween. The second washer is then attached to member 52.

Assembly 10 allows the transfer of torque between pile segments 12 and 14 at the levels of torque expected to be encountered during the installation of helical piles. In use, pile segment 12 may be the lead pile having a plurality of helical plates attached thereto. The helical plates are driven into the ground by rotation applied to end 36 of pile segment 12. Using assembly 10, the helical pile can be extended by adding a pile segment 14 to pile segment 12. The pile segments 12, 14 are joined together by two or more fasteners 50 extending through two or more pairs of aligned aperture pairs 65*a*-67*a*, 65*b*-67*b*, 65*c*-67*c*, wherein the alignment of at least one of the two or more pairs of aligned aperture pairs is radially offset from the alignment of another pair. Washers 51 are used to secure fasteners 50 in place. Rotation may be imparted to pile segment 14 by a driver to drive the helical plates on pile segment 12 further into the ground. An additional pile segment may be added to the helical pile by connecting same to the trailing end of pile segment 14 using assembly 10. Torque can then be applied to the trailing end of the additional pile segment which transmits the torque to the leading pile to rotate the helical plates further into the ground as desired. Further extension pile segments may be applied in succession as will be readily apparent to those skilled in the art.

In one embodiment, coupler 16 may be pre-welded on to pile segment 14 and one end of member 52 may have a washer pre-welded thereon prior to delivery to the construction site, in order to minimize the amount of field welding required on site. This may help minimize assembly time on site. By having the alignment of at least one fastener radially offset from another fastener, assembly 10 helps ensure that all components therein, including the welds, are capable of transmitting the axial forces (i.e. tension and compression), shear forces, bending moments, and any torsional forces applied during installation that may be experienced by the helical pile system. Further, assembly 10 can be easily unassembled when necessary.

Therefore, a method for connecting a first pile segment to a second pile segment of a helical pile system is provided herein. The method comprises:

inserting a first end of the second pile segment into a coupler provided on a first end of the first pile segment, the second pile segment having a sidewall and two or more aperture pairs formed in the sidewall, and at least one of the two or more aperture pairs having an alignment radially offset from an alignment of at least one other aperture pair; and the coupler having a sidewall and two or more aperture pairs formed in the sidewall, and at least one of the two or more aperture pairs having an alignment radially offset from an alignment of at least one other aperture pair;

aligning at least two of the two or more aperture pairs of the second pile segment, including the at least one aperture pair having an offset alignment, with at least two of the two or more aperture pairs of the coupler, including the at least one aperture pair having an offset alignment;

inserting a fastener through each of the at least two aligned aperture pairs such that each end of the fastener extends through and engages both the sidewalls of the second pile segment and the coupler; and securing the fastener to prevent the fastener from being slidingly removable from the at least two aligned aperture pairs.

As a skilled person in the art can appreciate, the detailed specification of the components of the helical pile assembly (including but not limited to lengths, diameter, wall thickness, material grade, number of apertures and fasteners, spacing of the apertures, etc.) can be selected and/or determined depending on various factors, including for example the load to be carried by the pile, soil type, etc.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the present invention and the claims below. Thus, the present invention is not intended to be limited to the embodiments shown herein, but is to be accorded the full scope consistent with the claims. The terminology used herein is for the purpose of describing particular examples only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "another", as used herein, is defined as at least a second or more. The terms "including" and "having," as used herein, are defined as comprising (i.e., open language). All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A method for connecting a first pile segment to a second pile segment of a helical pile system, the method comprising:

inserting a first end of the second pile segment into a coupler provided on a first end of the first pile segment, the coupler comprising a tubular member being attached to the first pile segment in a substantially coaxial manner and fitting over the first end of the first and second pile segments in an overlapping manner, the second pile segment having a pile sidewall and two or more pile aperture pairs formed in the pile sidewall, each of which having an alignment, and the alignment of at least one of the two or more pile aperture pairs is radially offset from the alignment of at least one other pile aperture par by up to about 90°; and the coupler having a coupler sidewall and two or more coupler aperture pairs formed in the coupler sidewall, each of which having an alignment, and the alignment of at least one of the two or more coupler aperture pairs is radially offset from the alignment of at least one other coupler aperture pair by up to about 90°;

aligning at least two of the two or more pile aperture pairs with at least two of the two or more coupler aperture pairs, such that at least one aperture of the two or more pile aperture pairs aligns in an alternating fashion with at least one aperture of the two or more coupler aperture pairs;

inserting a fastener through each of the at least two aligned pile and coupler aperture pairs such that each end of the fastener extends through and engages both the pile sidewall and the coupler sidewall; and securing the fastener to prevent the fastener from being slidingly removable from the at least two aligned pile and coupler aperture pairs.

2. The method of claim 1, wherein the fastener comprises an elongated member having a first washer attached to a first end thereof, and wherein the step of inserting the fastener comprises inserting a second end of the elongated member through each of the at least two aligned pile and coupler aperture pairs, and wherein the step of securing comprises attaching a second washer to the second end of the elongated member.

3. The method of claim 2, wherein one or both of the washers are contoured to substantially match a curvature of the outer surface of the coupler sidewall, and the method further comprises positioning one or both of the washers to matingly abut against the coupler sidewall.

4. The method of claim 1, wherein the alignment of one or more of the at least two aligned pile and coupler aperture pairs are substantially transverse to a longitudinal axis of the second pile segment and/or the coupler.

5. The method of claim 1, wherein one or more of the at least two aligned pile and coupler aperture pairs comprise two pile apertures in the pile sidewall that are radially separated by about 180° relative to a central longitudinal axis of the second pile segment and/or two coupler apertures in the coupler side wall that are radially separated by about 180° relative to a central longitudinal axis of the coupler.

6. The method of claim 1, wherein the first end of the second pile segment is inserted into the coupler in a substantially coaxial manner.

7. The method of claim 1, wherein the coupler is welded on to the first pile segment.

8. A coupler for connecting a first pile segment and a second pile segment in helical pile system, the first pile segment having a first end and the second pile segment having a sidewall, a first end, and two or more pile aperture pairs formed in the sidewall near the first end, the coupler comprising:

a tubular sidewall;

a first end for substantially coaxially fitting over the first end of the first pile segment in an overlapping manner; and a second end for receiving the first end of the second pile segment, the second end having two or more coupler aperture pairs formed in the sidewall, each of which having an alignment, and the alignment of at least one of the two or more coupler aperture pairs is radially offset from the alignment of at least one other coupler aperture pair by up to about 90°, the two or more coupler aperture pairs for alignment with the two or more pile aperture pairs such that at least one aperture of the two or more pile aperture pairs aligns in an alternating fashion with at least one aperture of the two or more coupler aperture pairs and each for receiving a fastener therethrough.

9. The coupler of claim 8, wherein the alignment of one or more of the two or more coupler aperture pairs are substantially transverse to a longitudinal axis of the coupler.

10. The coupler of claim 8, wherein one or more of the two or more coupler aperture pairs comprise two apertures in the coupler sidewall that are radially separated by about 180° relative to a central longitudinal axis of the coupler.

11. The coupler of claim 8, wherein the first end of the second pile segment is receivable in the second end of the coupler in a substantially coaxial manner.

12. A helical pile assembly comprising:

a first pile segment having a sidewall and a first end;

a coupler having a tubular sidewall, a first end fitted substantially coaxially over the first end of the first pile segment in an overlapping manner, a second end, two or more coupler aperture pairs formed in the sidewall near the second end, each of the coupler aperture pairs having an alignment and the alignment of at least one of the coupler aperture pairs being radially offset from the alignment of at least one other coupler aperture pair by up to about 90°;

a second pile segment having a sidewall, a first end received in the coupler at the second end of the coupler in an overlapping manner, and two or more pile aperture pairs formed in the sidewall near the first end and aligned with at least two of the two or more coupler aperture pairs, including the at least one coupler aperture pair having the radially offset alignment such that at least one aperture of the two or more pile aperture pairs aligns in an alternating fashion with at least one aperture of the two or more coupler aperture pairs; and a fastener received in each pair of the aligned pile and coupler aperture pairs to secure the second pile segment to the coupler.

13. The helical pile assembly of claim 12, wherein the fastener comprises an elongated member having a first end and a second end, and each of the first and second ends extends through and engages both the sidewalk of the second pile segment and the coupler.

14. The helical pile assembly of claim 13, wherein the first and second ends of the fastener protrude from an outer surface of the coupler's sidewall, and the fastener further comprises a first washer attached to the first end of the elongated member and a second washer attached to the second end of the elongated member, both washers being external to the outer surface of the coupler's sidewall.

15. The helical assembly of claim 14, wherein one or both of the first and second washers are contoured to substantially match a curvature of the outer surface of the coupler's sidewall and matingly abut against the outer surface of the coupler's sidewall.

16. The helical assembly of claim 12, wherein the alignment of one or more of the at least two aligned pile and coupler aperture pairs are substantially transverse to a longitudinal axis of the second pile segment and/or the coupler.

17. The helical assembly of claim 12, wherein one or more of the at least two aligned pile and coupler aperture pairs comprise two pile apertures in the pile's sidewall that are radially separated by about 180° relative to a central longitudinal axis of the second pile segment and/or two coupler apertures in the coupler's sidewall that are radially separated by about 180° relative to a central longitudinal axis of the coupler.

18. The helical assembly of claim 12, wherein the second pile segment is received in the coupler in a substantially coaxial manner.

19. The helical assembly of claim 12, wherein the coupler is connected to the first pile segment by welding.

* * * * *